US009637200B2

(12) United States Patent
Ledford

(10) Patent No.: US 9,637,200 B2
(45) Date of Patent: May 2, 2017

(54) TWIN HULL FOLDOUT WATERCRAFT

(71) Applicant: Henry Franklin Ledford, High Point, NC (US)

(72) Inventor: Henry Franklin Ledford, High Point, NC (US)

(73) Assignee: Henry F. Ledford, High Point, NC (US)

( * ) Notice: Subject to any disclaimer, the term of this patent is extended or adjusted under 35 U.S.C. 154(b) by 0 days.

(21) Appl. No.: 14/741,858

(22) Filed: Jun. 17, 2015

(65) Prior Publication Data

US 2016/0368568 A1 Dec. 22, 2016

(51) Int. Cl.

| | |
|---|---|
| ***B63B 7/00*** | (2006.01) |
| ***B63B 7/02*** | (2006.01) |
| ***B63B 1/12*** | (2006.01) |
| ***B63H 16/00*** | (2006.01) |
| ***B63H 20/00*** | (2006.01) |
| *B63H 5/07* | (2006.01) |
| *B63H 5/125* | (2006.01) |

(52) U.S. Cl.

CPC ..... *B63B 7/02* (2013.01); *B63B 1/121* (2013.01); *B63H 16/00* (2013.01); *B63H 20/007* (2013.01); *B63B 2007/003* (2013.01); *B63B 2007/006* (2013.01); *B63H 2005/075* (2013.01); *B63H 2005/1258* (2013.01)

(58) Field of Classification Search

CPC .. B63B 7/02; B63B 7/00; B63B 1/121; B63B 1/10; B63H 5/07; B63C 13/00; B65D 85/00

USPC ..... 114/28, 29, 352, 353

See application file for complete search history.

(56) References Cited

U.S. PATENT DOCUMENTS

| | | | | |
|---|---|---|---|---|
| 1,114,996 | A * | 10/1914 | Lawson | B63B 7/06 114/354 |
| 4,366,769 | A * | 1/1983 | Lingeman | B63B 3/08 114/352 |
| 5,870,966 | A * | 2/1999 | Christian | B63B 7/04 114/283 |
| 5,957,080 | A * | 9/1999 | Ovard | B63B 7/04 114/353 |
| 2001/0029880 | A1 * | 10/2001 | McCarthy | B60R 9/045 114/353 |

* cited by examiner

*Primary Examiner* — Anthony Wiest

(57) ABSTRACT

A twin hull foldout watercraft that quickly and easily deploys from a small mobile and portable size unit that will fit into a vehicle or stow in a closet, camper or larger boat to a dry stable watercraft that could be used with small motor, paddles, ores, stand up paddles, push poles or sail and which has all parts and accessories attached thereto. The twin hull foldout watercraft comprises a central deck, two side mounted hull flaps hingedly attached to the opposing side edges of the central deck and positionable in a vertical or horizontal position, a fore deck extension member hingedly attached to the front edge of the central deck and positionable in a vertical or horizontal position, and an aft deck extension member hingedly attached to the rear edge and which can be extended out from the rear of the central deck.

20 Claims, 6 Drawing Sheets

TWIN HULL FOLDOUT WATERCRAFT

DETAILED DESCRIPTION OF THE INVENTION

Figure 1:
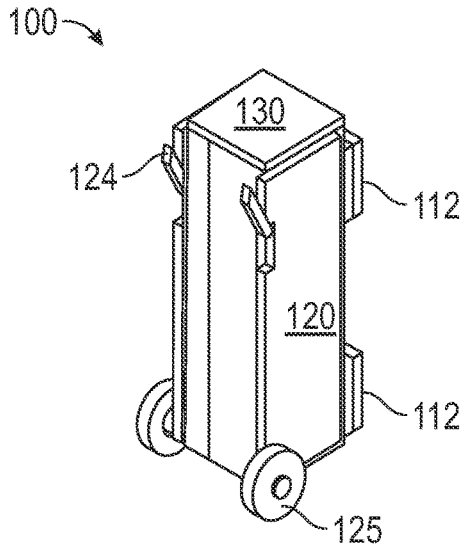
FIG. 1 is a left side perspective view of a twin hull foldout watercraft built in accordance with the present invention shown in an upright orientation in its storage configuration.
Figure 2:
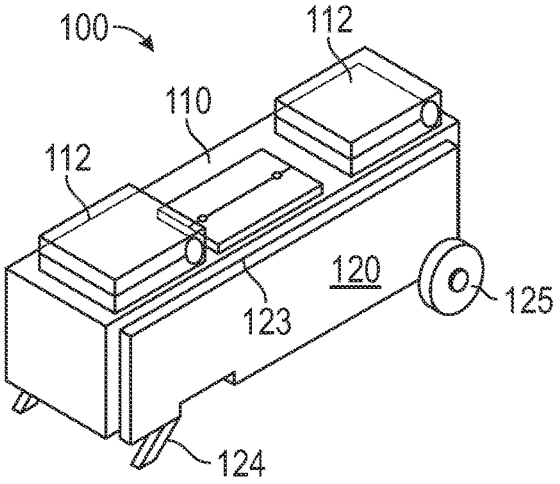
FIG. 2 is a left side perspective view of a twin hull foldout watercraft built in accordance with the present invention shown in a lateral orientation in its storage configuration.
Figure 3:
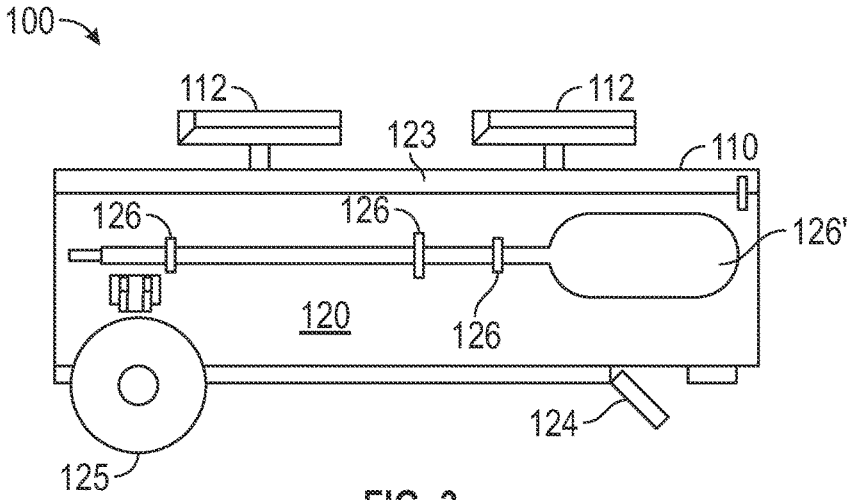
FIG. 3 is a right side elevational view of a twin hull foldout watercraft built in accordance with the present invention shown in a lateral orientation in its storage configuration.
Figure 4:
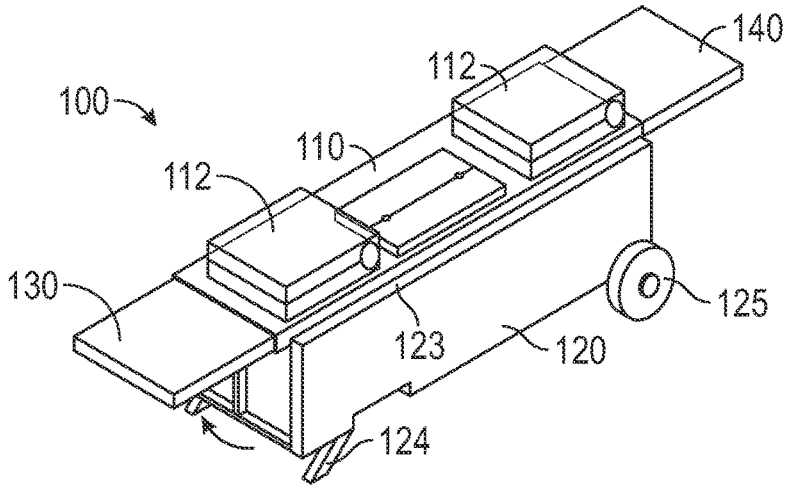
FIG. 4 is a left side perspective view of a twin hull foldout watercraft built in accordance with the present invention shown in a lateral orientation between its storage configuration and its deployed configuration.
Figure 5:
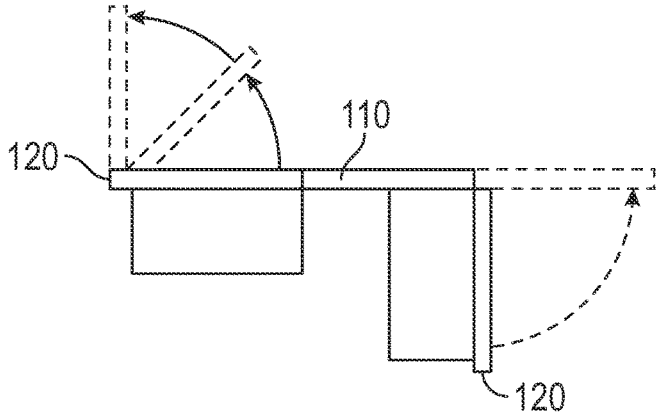
FIG. 5 is a front elevational view of a center deck of a two hull foldout watercraft built in accordance with the present invention shown between its storage configuration and deployed configuration, with the progression of its fold out hull flaps in shadow.
Figure 6:
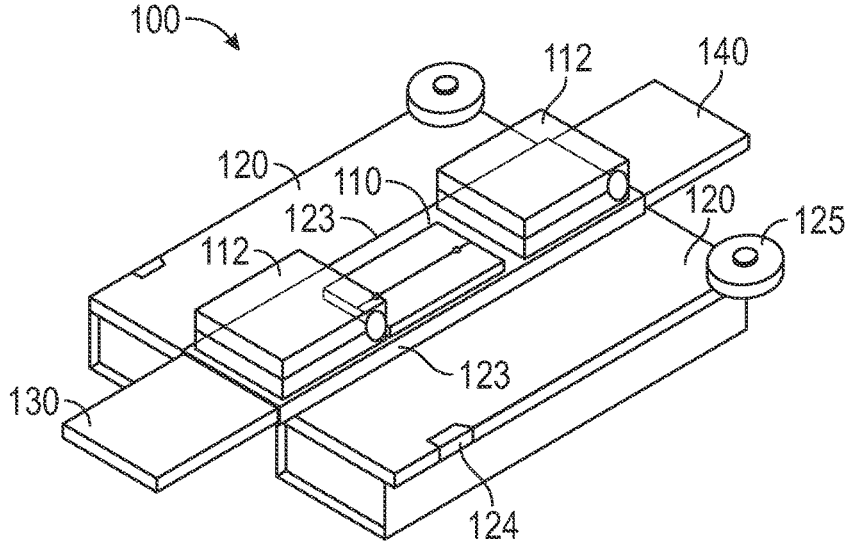
FIG. 6 is a left side perspective view of a twin hull foldout watercraft built in accordance with the present invention shown in a lateral orientation between its storage configuration and its deployed configuration.
Figure 7:
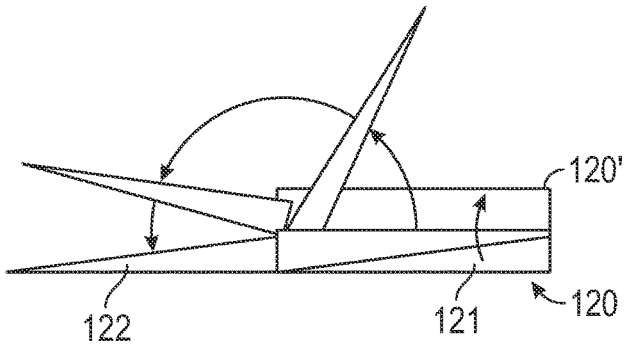
FIG. 7 is a side elevational view of a hull flap of a twin hull foldout watercraft built in accordance with the present invention shown between its storage configuration and its deployed configuration.
Figure 8:
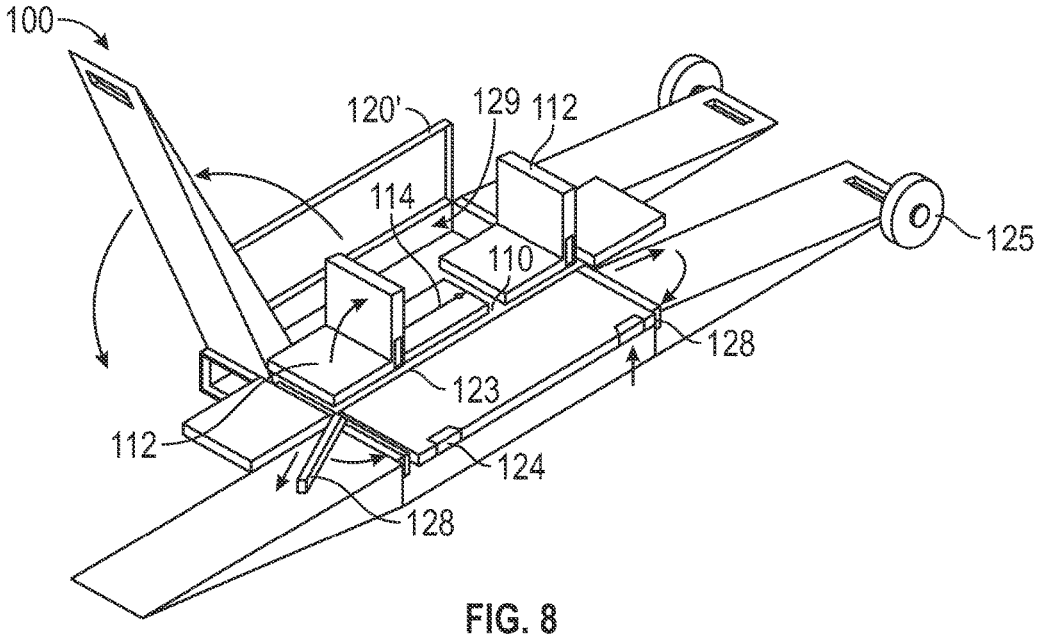
FIG. 8 is a left side perspective view of a twin hull foldout watercraft built in accordance with the present invention shown in a lateral orientation between its storage configuration and its deployed configuration.
Figure 9:
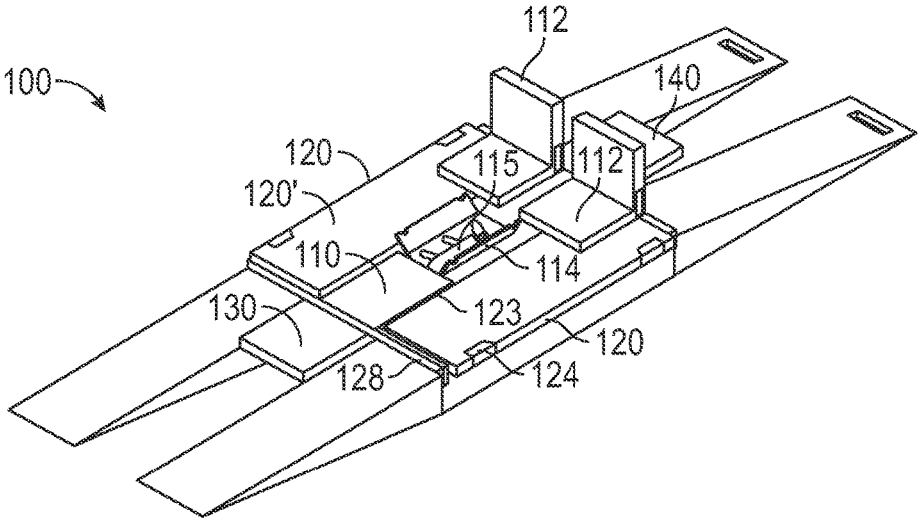
FIG. 9 is a left side perspective view of a twin hull foldout watercraft built in accordance with the present invention shown in a lateral orientation in its deployed configuration.
Figure 10:
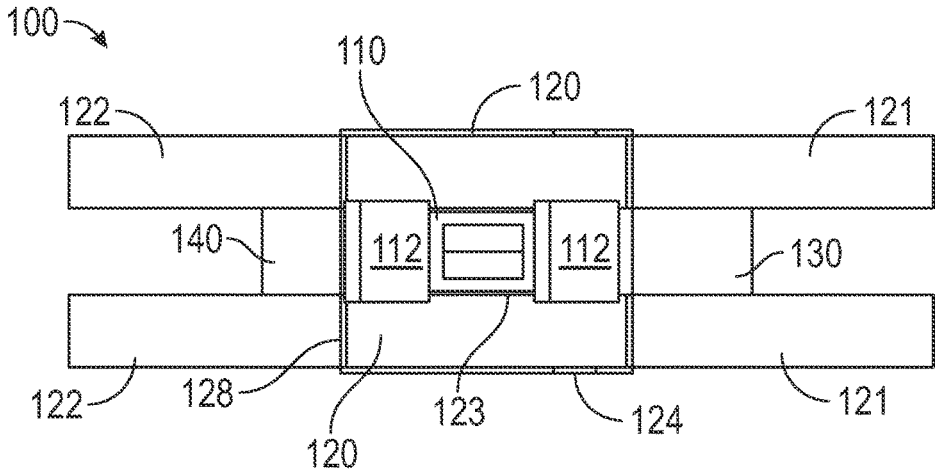
FIG. 10 is a top plan view of a twin hull foldout watercraft built in accordance with the present invention shown in a lateral orientation in its deployed configuration.

Referring now to the drawings and in particular FIGS. 1, 2, 3, 4, 5, 6, 7, 8, 9 and 10, a twin hull foldout watercraft 100 built in accordance with the present invention is selectively configurable in a storage configuration, as illustrated in FIGS. 1-3, and deployed configuration, as illustrated in FIGS. 9-10. The twin hull foldout watercraft 100 defines a watercraft housing having a central deck 110, two side mounted hull flaps 120, a fore deck extension member 130, and an aft deck extension member 140. The central deck 110 defines a horizontally oriented planar panel having a front edge, two opposing side edges, and a rear edge. The side mounted hull flaps 120 are hingedly attached to the opposing side edges of the central deck 110 such that they may be hinged between a vertical position relative to the central deck 110 wherein they extend down from the respective side edges of the central deck or a horizontal position relative to the central deck 110 wherein they extend horizontally on the same plane as the central deck 110. It is understood that in one embodiment, support beams are used to selectively locked the hull flaps 120 in the horizontal position relative to the central deck 110. In another embodiment, a lockable hinge is employed to attach the hull flaps 120 to the central deck 110, thereby enabling each individually to be selectively locked into the horizontal position relative to the central deck 110.

The fore deck extension member 130 is hingedly attached to the front edge of the central deck 110 such that it, similar to the hull flaps 120, can be hinged between a vertical position relative to the central deck 110 wherein it extends down from the front edge of the central deck or a horizontal position relative to the central deck 110 wherein it extends horizontally from the front edge of the central deck 110 on the same plane thereof. It is understood that a lockable hinge is employed to attach the fore deck extension member 130 to the central deck 110, thereby enabling it to be selectively locked into the horizontal position relative to the central deck 110.

The aft deck extension member 140 is hingedly attached to the rear edge of the central deck 110 such that it, similar to the hull flaps 120 and fore deck extension member 130, can be hinged between a vertical position relative to the central deck 110 wherein it extends down from the rear edge of the central deck or a horizontal position relative to the central deck 110 wherein it extends horizontally from the rear edge of the central deck 110 on the same plane thereof. In one embodiment, a lockable hinge is employed to enable the aft deck extension member 140 to be selective fixed in the horizontal position.

Each hull flap 120 of the twin hull foldout watercraft 100 includes folding top section 120', a fold out fore hull extension 121 and an aft hull extension 122 integral therewith. In the preferred embodiment, folding top 120' is hinged to the distal edge of the hull flap 120 relative to the central deck 110 and swingable between an open position, as illustrated for the right side hull flap 120 in FIG. 8, and a closed position, as illustrated for the right side hull flap 120 in FIG. 9. The fore hull extension 121 is hingedly attached to the fore side of its respective hull flap 120 with a hinge 123 and aft hull extension 122 is hingedly attached to the aft side of its respective hull flap 120 with a hinge 123. The hull extensions 121, 122 are structured to swing between a hull position defined by the respective hull extension 121, 122 extending horizontally away from the edge of the hull flap 120 and a nested position defined by the respective hull extension 121, 122 being positioned within the structural profile of the hull flap 120. The hinged attachment of the respective hull extensions 121, 122 to the respective edges of the hull flap 120 enables the hull extensions 121, 122 to sequentially swing between the hull position and the nested position. FIG. 7 illustrates the progression of the fore hull extension 121 swinging between its nested position and its hull position.

It is contemplated that when the respective hull extensions 121, 122 have been moved to the hull position, the space 129 vacated by the hull extensions 121, 122 in the hull flaps 120 may be used for storage.

In one embodiment, a plurality of hull support beam 128 are integral with the hull flap 120, with one at each hinge 123. The hull support beams can be extended from the hull flap 120 when the hull extensions 121, 122 are in the hull position and moved across the shared edge of the hull flap 120 and the respective hull extension 121, 122 so as to selectively hold the hull extension 121, 122 in the hull position.

Each hull flap 120 of the twin hull foldout watercraft 100 additionally includes a front stand member 124 hingedly attached thereto, a detachable wheel assembly 125, and paddle clips 126. The front stand members 124 may swung between an extended position, as shown in FIGS. 1, 2, 3, and 4, wherein they extend away from their respective hull flap 120 and a retracted position, as shown in FIGS. 6, 8-10, and 12, wherein they are positioned adjacent to their respective hull flap 120, aligned with its edge. The wheel assemblies 125 are positioned on their respective hull flap 120 such that when the hull flap 120 is in its vertical position relative to the central deck 110, it will extend below the edge of the hull flap 120 sufficient to contact a ground surface over which the watercraft 100 is located. In this regard, when the watercraft 100 is in its storage configuration and the front stand members 124 are in the extended position, the front stand members 124 provide a leg support structure on which the watercraft 100 may stand on and the wheel assemblies 125 provide opposing wheels that enable the watercraft 100 to roll.

It is contemplated that the paddle clips 126 allow the selective attachment of a paddle 126' to the hull flap 120.

Figure 14:
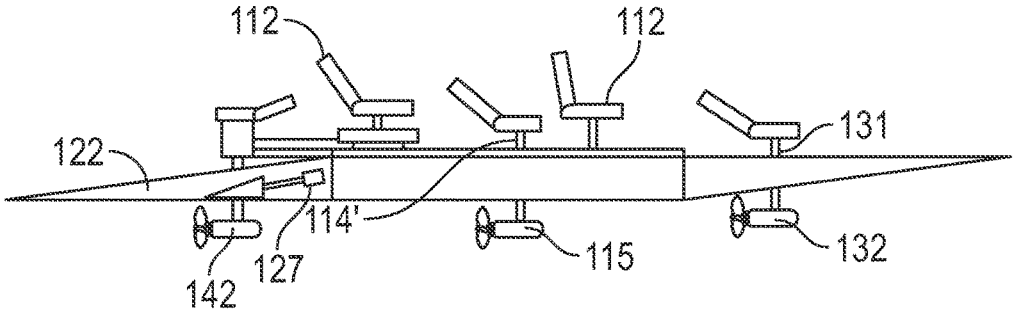
FIG. 14 is side elevational view of a twin hull foldout watercraft built in accordance with the present invention shown in a deployed configuration with various motor positions in shadow.

It is appreciated that when the hull flaps 120 are moved to the horizontal position relative to the central deck 110, the detachable wheel assembly 125 may be moved to the aft hull extension 122, as exemplified in FIG. 8, left in place on the hull flaps 120, as exemplified in FIG. 14, or removed altogether as exemplified in FIG. 9. It is contemplated that in the preferred embodiment, the detachable wheel assemblies 125 are each attached to an aperture on the hull flaps 120 with a conventional nut and bolt style fastening system.

The central deck 110 of the twin hull foldout watercraft 100 additionally includes two seat assemblies 112 selectively attached thereto. In the preferred embodiment, each seat assembly 112 can be flipped between a down position, as illustrated in FIGS. 2 and 3 to an up position, as illustrated in FIGS. 8 and 9. It is contemplated that in the preferred embodiment, the seat assemblies 112 are each attachable to an aperture on the central deck 110 with a conventional nut and bolt style fastening system.

Figure 11A:
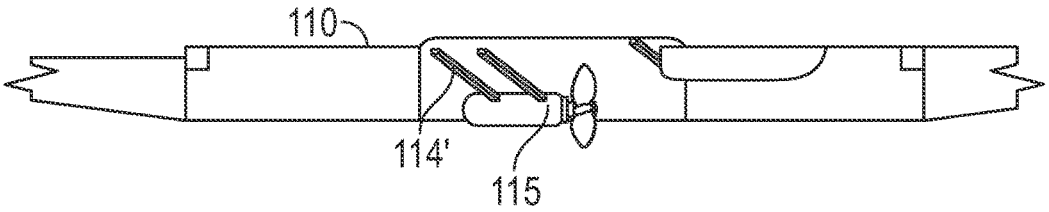
FIG. 11A is a side elevational view of a cross section of a central motor of a twin hull foldout watercraft built in accordance with the present invention shown with its central engine in a storage configuration.
Figure 11B:
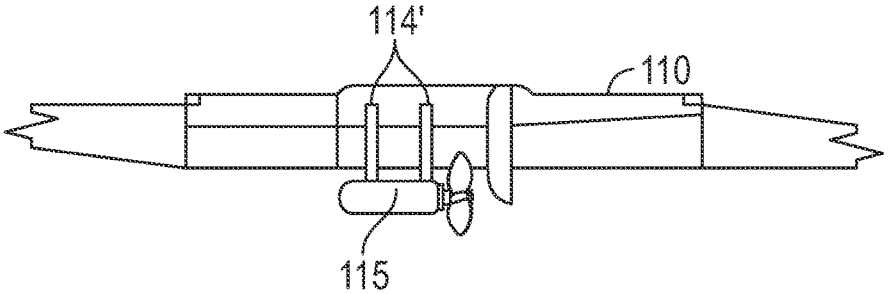
FIG. 11B is a side elevational view of a cross section of a central motor of a twin hull foldout watercraft built in accordance with the present invention shown with its central engine in a deployed configuration
Figure 12:
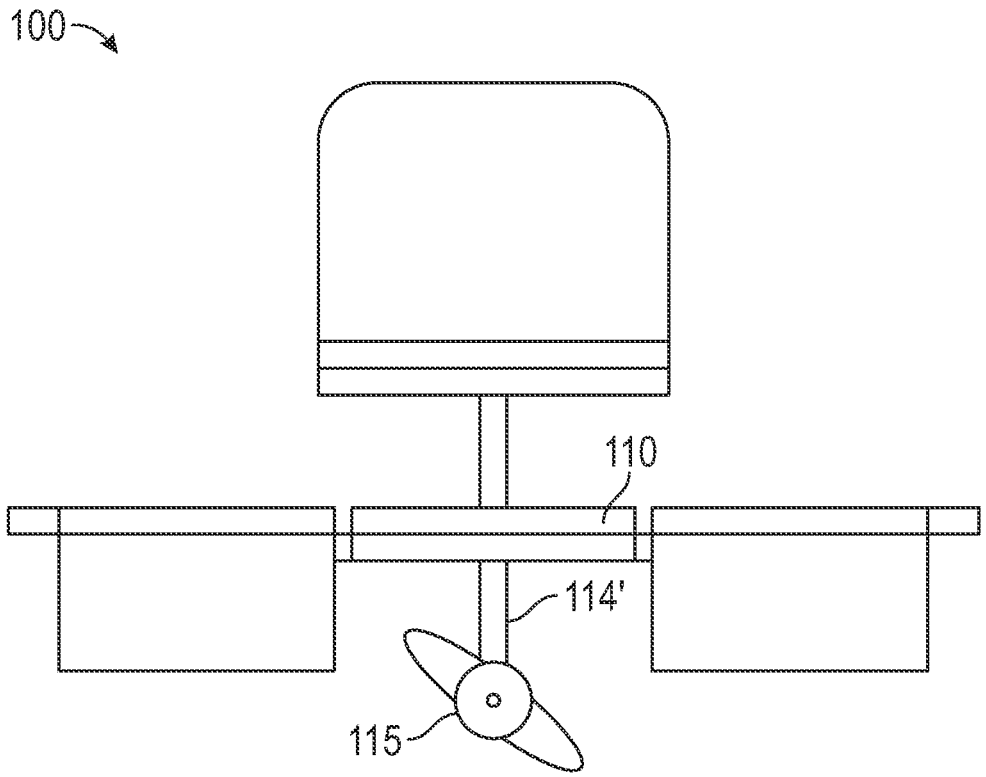
FIG. 12 is a front elevational view of a twin hull foldout watercraft built in accordance with the present invention shown in a deployed configuration with the wheels removed.
Figure 13A:
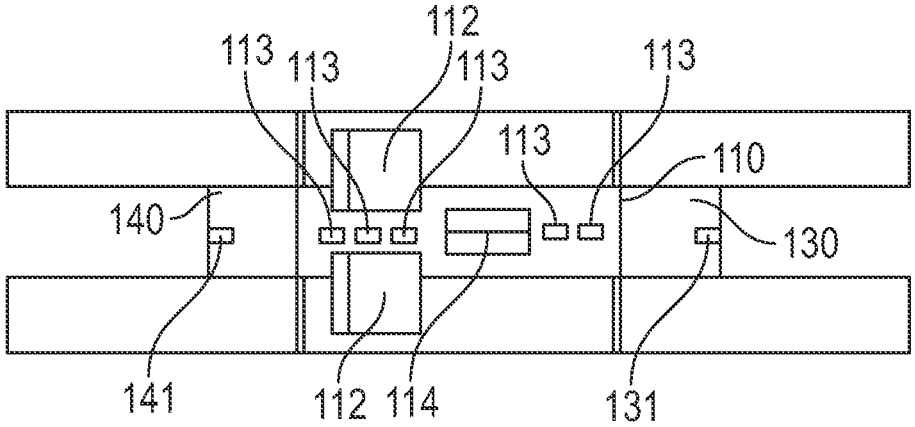
FIG. 13A is a top plan view of a twin hull foldout watercraft built in accordance with the present invention shown in a deployed configuration with the seats in a first arrangement.
Figure 13B:
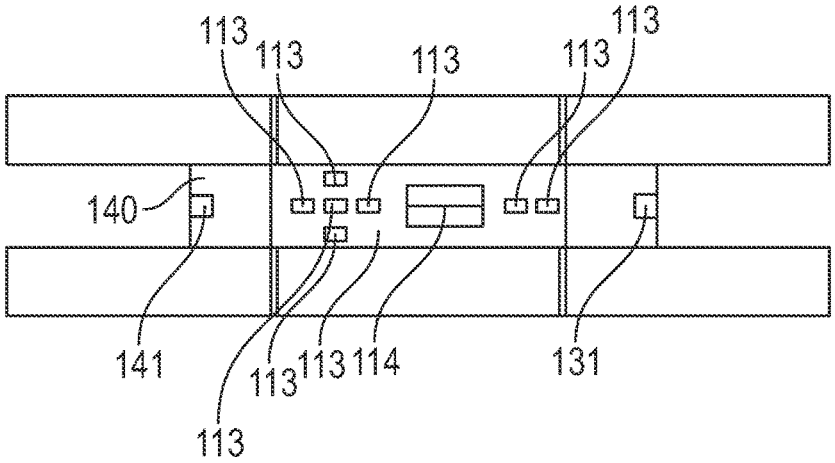
FIG. 13B is a top plan view of a twin hull foldout watercraft built in accordance with the present invention shown in a deployed configuration with the seats removed to allow use as a stand up paddle board.
Figure 13C:
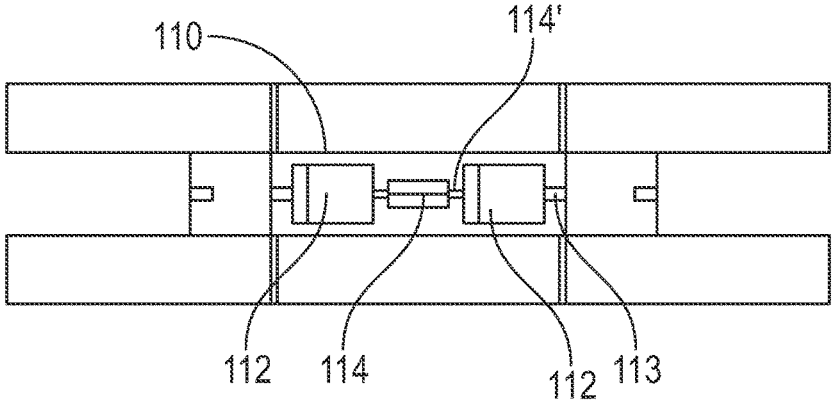
FIG. 13C is a top plan view of a twin hull foldout watercraft built in accordance with the present invention shown in a deployed configuration with the seats in a second arrangement.

Referring now to FIGS. 2, 4, 6, 8, 9, 10, 11A, 11B, and 12, in one embodiment, the central deck 110 additionally includes central motor area 114, defined as a closeable opening in the surface of the central deck 110 having an integral mounting structure 114' that enables a conventional propeller motor 115 to be placed therein and be selectively moved between a storage configuration, as illustrated in FIG. 11A, and a deployed configuration, as illustrated in FIG. 11B. It is appreciated that in the deployed configuration, the propeller motor 115 extends sufficiently down vertically such that its propellers may be used for propulsion when the watercraft 100 is in water in its deployed configuration.

Referring now to FIGS. 13A, 13B, 13C, and 14, in one embodiment the central deck 110 includes a plurality of seat receiving apertures 113 in its surface, each positioned to receive a seat assembly 112 so as to enable the seat assembly 112 to be fastened to the central deck 110 at that location.

In one embodiment, a fore motor mount 131 may be attached to the fore deck extension member 130, thereby enabling a conventional propeller motor 132 to be placed therein and extend sufficiently down vertically such that its propellers may be used for propulsion.

In the one embodiment, the aft deck extension member 140 includes a motor mount 141 sized to receive and hold a conventional propeller motor 142. The motor mount 141 is positioned on the aft deck extension member 140 such when the aft deck extension member 140 is in its extension position, a motor 142 mounted therein will extend sufficiently down vertically such that its propellers may be used for propulsion. It is contemplated that the motor mount 141 defines a mounting structure that enable sufficient manipulation of a mounted propeller motor 142 to facilitate is use for propulsion and steering.

In one embodiment, the aft hull extensions 122 each include a conventional propeller motor 127 disposed within its profile.

It is appreciated that because the twin hull foldout watercraft 100 is configured to allow the selective attachment of its wheel assemblies 125, paddles 126', propeller motor 142, and seat assemblies 112, the twin hull foldout watercraft 100 enables substantially all parts involved in the conversion between a storage configuration and deployed configuration to remain attached at all times (if desired). Advantageously, by keeping all of such parts attached, a user is less likely to lose parts when using the twin hull foldout watercraft 100 or when storing the same.

It is contemplated that in one embodiment, the twin hull foldout watercraft 100 measures 14" by 14" by 48" when in the storage configuration and 7" by 41" by 11', 6" in the deployed configuration. In alternate embodiments, the twin hull foldout watercraft 100 may measure 3' in the storage configuration and approximately 9' in the deployed configuration, 6' in the storage configuration and approximately 18' in the deployed configuration, or 8' in the storage configuration and approximately 24' in the deployed configuration.

The present invention has been shown and described herein in what is considered to be the most practical and preferred embodiment. It is recognized, however, that departures may be made therefrom within the scope of the invention and that obvious modifications will occur to a person skilled in the art.

What is claimed is:

1. A twin hull foldout watercraft having a storage configuration and a deployed configuration, comprising:

a central deck defining a horizontally oriented member having a front edge, two opposing side edges, and a rear edge;

two hull flaps integral with the opposing side edges of the central deck such that they may individually be positioned in a vertical position relative to the central deck wherein they extend down from the respective side edges of the central deck and a horizontal position relative to the central deck wherein they extend horizontally in parallel with the central deck;

each hull flap of the twin hull foldout watercraft includes a folding too section, a fold out fore hull extension and a fold out aft hull extension integral therewith; wherein the folding top is hinged to a distal edge of the hull flap relative to the central deck and swingable between an open position and a closed position;

the fore hull extension is hingedly attached to a fore side of its respective hull flap with a hinge and aft hull extension is hingedly attached to an aft side of its respective hull flap with a hinge; and each hull extension are structured to swing between a deployed position defined by the respective hull extension extending horizontally away from the distal edge of the hull flap and a storage position defined by the having the fore hull extension and aft hull extension each folded within the hull flap such that the extensions do not extend beyond a perimeter of the hull flap.

2. The twin hull foldout watercraft of claim 1, wherein the storage configuration of said fore hull extension and said aft hull extension defines a nested position in which the fore hull extension and the aft hull extension are positioned within the perimeter of the hull flap, such that the fore and aft hull extensions do not extend beyond the edges of the hull flap in any direction.

3. The twin hull foldout watercraft of claim 1, wherein the fore hull extension and aft hull extension are hingedly attached to their respective hull flap enabling the hull extensions to sequentially swing between the delayed configuration and the storage configuration.

4. The twin hull foldout watercraft of claim 1, wherein the two hull flaps are hingedly attached to the opposing side edges of the central deck such that they may individually be hinged between in a vertical position relative to the central deck wherein they extend down from the respective side edges of the central deck and a horizontal position relative to the central deck wherein they extend horizontally relative to the water's surface when the watercraft is in the water from the central deck.

5. The twin hull foldout watercraft of claim 1, additionally comprising a fore deck extension member integral with the front edge of the central deck and configured to be selectively positionable in a vertical position relative to the central deck wherein it extends down from the front edge of the central deck and a horizontal position relative to the central deck wherein it extends horizontally from the front edge of the central deck.

6. The twin hull foldout watercraft of claim 5, wherein the fore deck extension member extends horizontally relative to the water's surface when the watercraft is in the water from the central deck when in the horizontal position.

7. The twin hull foldout watercraft of claim 5, wherein the fore deck extension member is hingedly attached to the front edge of the central deck such that it is hinged between the vertical position relative to the central deck and the horizontal position relative to the central deck.

8. The twin hull foldout watercraft of claim 5, additionally comprising a fore motor mount integral with the fore deck extension member, wherein said fore motor mount enables the attachment of a propeller motor to the fore deck extension member.

9. The twin hull foldout watercraft of claim 1, additionally comprising an aft deck extension member integral with the rear edge of the central deck and selectively positionable in a horizontal position extending behind the central deck.

10. The twin hull foldout watercraft of claim 9, wherein the aft deck extension member is additionally positionable in a vertical position relative to the central deck wherein it extends down from the rear edge of the central deck.

11. The twin hull foldout watercraft of claim 9, wherein the aft deck extension member is hingedly attached to the rear edge and swings between the horizontal position and the extension position.

12. The twin hull foldout watercraft of claim 9, wherein the aft deck extension member includes a motor mount sized to receive and hold a conventional propeller motor.

13. The twin hull foldout watercraft of claim 1, wherein at least one of the hull flaps includes a front stand member selectively positionable in an extended position in which it is adapted to contact a ground surface when the hull flap is in its vertical position relative to the central deck.

14. The twin hull foldout watercraft of claim 1, wherein at least one of the hull flaps includes a wheel assembly configured to contact a ground surface when the respective hull flap is in its vertical position relative to the central deck.

15. The twin hull foldout watercraft of claim 14, wherein the wheel assembly is detachable, wherein the fore and aft hull extensions are wedge shaped to properly balance displacement fore-aft on the watercraft and provide stable floatation.

16. The twin hull foldout watercraft of claim 15, wherein the central deck includes at least one seat assembly integral therewith.

17. The twin hull foldout watercraft of claim 16, additionally comprising a central motor mount integral with the central deck, wherein said central motor mount enables the attachment of a propeller motor to the central deck.

18. The twin hull foldout watercraft of claim 17, wherein at least one of said aft hull extensions includes a conventional propeller motor integral therewith.

19. A twin hull foldout watercraft having a storage configuration and a deployed configuration, comprising:

a central deck defining a horizontally oriented member having a front edge, two opposing side edges, and a rear edge;

a central motor mount integral with the central deck, wherein said central motor mount enables the attachment of a propeller motor to the central deck;

two hull flaps integral with the opposing side edges of the central deck such that they may individually be positioned in a vertical position relative to the central deck wherein they extend down from the respective side edges of the central deck and a horizontal position relative to the central deck wherein they extend horizontally as the central deck;

each hull flap of the twin hull foldout watercraft includes a folding top section, a fold out fore hull extension and a fold out aft hull extension integral therewith, wherein the folding top is hinged to a distal edge of the hull flap relative to the central deck and swingable between an open position and a closed position;

a fore hull extension and an aft hull extension integral with each of said hull flaps, wherein said fore full extension and said aft hull extension are each selectively positionable in a hull position defined by the fore hull extension and aft hull extension each extending horizontally away from the distal edge of the hull flap and a nested position in which the fore full extension and the aft hull extension are folded within the hull flap so that they do not extend beyond the perimeter of the hull flap;

a fore deck extension member integral with the front edge of the central deck and configured to be selectively positionable in a vertical position relative to the central deck wherein it extends down from the front edge of the central deck and a horizontal position relative to the central deck wherein it extends horizontally from the front edge of the central deck; and an aft deck extension member integral with the rear edge of the central deck and selectively positionable in a horizontal position extending behind the central deck.

20. The twin hull foldout watercraft of claim 19, wherein:

at least one of the hull flaps includes a wheel assembly configured to contact a ground surface when the respective hull flap is in its vertical position relative to the central deck; and the central deck includes at least one seat assembly integral therewith.

* * * * *